US009042782B2

(12) United States Patent
Nakai et al.

(10) Patent No.: US 9,042,782 B2
(45) Date of Patent: May 26, 2015

(54) NEUTRALIZATION DEVICE AND IMAGE FORMING APPARATUS

(71) Applicant: KYOCERA Document Solutions Inc., Osaka-shi (JP)

(72) Inventors: Jun Nakai, Osaka (JP); Takeshi Watanabe, Osaka (JP); Katsuya Ota, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 97 days.

(21) Appl. No.: 13/711,330

(22) Filed: Dec. 11, 2012

(65) Prior Publication Data

US 2013/0156465 A1 Jun. 20, 2013

(30) Foreign Application Priority Data

Dec. 14, 2011 (JP) ..... 2011-272979

(51) Int. Cl.
*G03G 21/00* (2006.01)
*G03G 21/08* (2006.01)

(52) U.S. Cl.
CPC ..... *G03G 21/08* (2013.01)

(58) Field of Classification Search
CPC ..... G03G 21/08
USPC ..... 399/128, 129
See application file for complete search history.

(56) References Cited

U.S. PATENT DOCUMENTS 6,507,719 B2 * 1/2003 Furuya ..... 399/128
2006/0188288 A1 * 8/2006 Tomiie et al. ..... 399/128
2010/0054792 A1 * 3/2010 Goda et al. ..... 399/95
2011/0020034 A1 * 1/2011 Tsutsumi ..... 399/128
2012/0027451 A1 * 2/2012 Shin ..... 399/98

FOREIGN PATENT DOCUMENTS

JP 2006-234882 9/2006

OTHER PUBLICATIONS

Beam Deflection Formulae, p. 2. {retrieved on May 12, 2014] . Retrieved from the Internet <URL:http://www.advancepipeliner.com/Resources/Others/Beams/Beam_Deflection_Formulae.pdf>. *

* cited by examiner

*Primary Examiner* — Billy Lactaoen
*Assistant Examiner* — Arlene Heredia Ocasio
(74) *Attorney, Agent, or Firm* — Pearl Cohen Zedek Latzer Baratz LLP

(57) ABSTRACT

The light emitting portions 140 are mounted on the substrate 120, and emit neutralization light. The first end engagement portion 115 is engaged with the first end portion 121 of the substrate 120 opposite to the image carrier 2. The partitioning member 130 is connected to the housing 110, so as to form an opened portion that is opened to face the surface of the image carrier 2. The plurality of restriction protrusions 150 are arranged along an axial direction of the image carrier 2. The first end engagement portion 115 is disposed in the central portion of the plurality of restriction protrusions 150 in the arrangement direction. The arrangement direction of the plurality of restriction protrusions 150 curves, such that a central portion of the restriction protrusions in the axial direction is closer to the image carrier than end portions of the restriction protrusions in the axial direction.

13 Claims, 11 Drawing Sheets

NEUTRALIZATION DEVICE AND IMAGE FORMING APPARATUS

This application is based on and claims the benefit of priority from Japanese Patent Application No. 2011-272979, filed on 14 Dec. 2011, the content of which is incorporated herein by reference.

BACKGROUND

The present disclosure relates to a neutralization device that irradiates an image carrier with neutralization light to discharge electricity of the image carrier, and to an electro-photographic image forming apparatus including the neutralization device.

In the electro-photographic image forming apparatus, cost reduction for the members is required, and downsizing of the housing of the apparatus is required. An exposure memory image generated on a surface of the photosensitive drum is required to be reduced for improving the performance of a photosensitive drum being an image carrier. In order to reduce generation of an exposure memory image, an area of the photosensitive drum after the transferring is required to be irradiated with neutralization light to discharge electricity on the surface of the photosensitive drum.

In general, a neutralization device is disposed between: a drum cleaning unit that removes attached matter such as toner remaining on the surface of the photosensitive drum; and a charging unit that charges the surface of the photosensitive drum. However, in a case in which the speed of forming an image is increased, the linear velocity (circumferential velocity) of the photosensitive drum is increased, and the period of time from the neutralization to the charging is significantly shortened. As a result, trapped carrier (charge) remains in a photosensitive layer of the photosensitive drum, and an exposure memory image causing deterioration of an image is likely to be generated.

For the purpose of suppressing generation of an exposure memory image, an image forming apparatus has been known, in which a neutralization device is disposed upstream from a cleaning device in a rotation direction of a photosensitive drum, so as to secure a period of time sufficient for eliminating trapped carrier between the neutralization and the charging.

In a case in which the neutralization device is disposed upstream from the cleaning device in the rotation direction of the photosensitive drum, the neutralization device is disposed in a position near downstream from the transfer unit. As a result, un-transferred toner that was not transferred on a sheet of paper and toner scattered after the transfer to the sheet of paper may attach to a light emitting portion being a neutralization light source of the neutralization device. For the purpose of suppressing attachment of toner to such a light emitting portion, a configuration is also employed in the conventional image forming apparatus, in which a partitioning member is provided between the conveyance path of a sheet of paper and the neutralization device, and an opened portion is formed between the partitioning member and the housing of the neutralization device, the opened portion being opened so as to face the surface of the photosensitive drum, and allowing neutralization light to pass therethrough.

However, in the conventional neutralization device, the space between the partitioning member and the housing of the neutralization device (i.e. the opened portion for allowing neutralization light to pass therethrough) is restricted by the size (diameter) of the photosensitive drum and by the conveyance path of a sheet of paper; therefore, it is difficult to secure a sufficient width in a circumferential direction of the photosensitive drum. As a result, the substrate, on which the light emitting portion of the neutralization device is mounted, is required to be disposed in parallel with the outer face of the housing.

In the conventional neutralization device, a base end side of the partitioning member is connected (fixed) to the housing, but another end side of the partitioning member is a free end. Therefore, in general, the free end of the opened portion of the partitioning member is composed of a thin and low-cost material (for example, resin), and thus is likely to bend toward the housing side. In particular, the free end of the partitioning member is likely to bend most significantly in its central portion in the longitudinal direction along an axial direction of the photosensitive drum. This brings about problems that: the opened portion is narrowed in its central portion of the photosensitive drum in the longitudinal direction along the axial direction; the quantity of neutralization light to be passed is reduced; and as a result, the distribution of the quantity of neutralization light is uneven along the axial direction of the photosensitive drum.

SUMMARY

The present disclosure is a neutralization device that irradiates a surface of an electrically charged image carrier with neutralization light to discharge electricity of the image carrier. The present disclosure includes a housing, a substrate, light emitting portions, a first end engagement portion, a partitioning member, and restriction protrusions. The substrate is connected to the housing. The light emitting portions are mounted on the substrate, and emit neutralization light. The first end engagement portion is engaged with a first end portion that is an end portion of the substrate opposite to the image carrier. The partitioning member is disposed to interpose the substrate between the partitioning member and the housing, and is connected to the housing on a base end portion side, so as to form an opened portion that is opened to face the surface of the image carrier. The plurality of restriction protrusions are arranged along an axial direction of the image carrier, between the surface of the image carrier and a second end portion that is an end portion opposite to the first end portion of the substrate. The first end engagement portion is disposed in a central portion of the plurality of restriction protrusions in an arrangement direction. The arrangement direction of the plurality of restriction protrusions curves in a holoscopic view, such that the central portion of the restriction protrusions in the arrangement direction is closer to the image carrier than ends of the restriction protrusions in the arrangement direction.

The present disclosure relates to an image forming apparatus including an image carrier, a charging unit, an exposure unit, a developing unit, and the neutralization device. The charging unit charges the image carrier. The exposure unit forms an electrostatic latent image on a surface of the image carrier. The developing unit forms a toner image by developing the electrostatic latent image, which is formed by the exposure unit, with toner. The neutralization device irradiates the surface of the image carrier with neutralization light to discharge electricity of the image carrier.

DETAILED DESCRIPTION

An embodiment of the present disclosure will be hereinafter described with reference to the attached drawings. Descriptions are provided for an entire structure of a printer 1 of an embodiment of an image forming apparatus of the present disclosure with reference to FIGS. 1 and 2.

Figure 1:
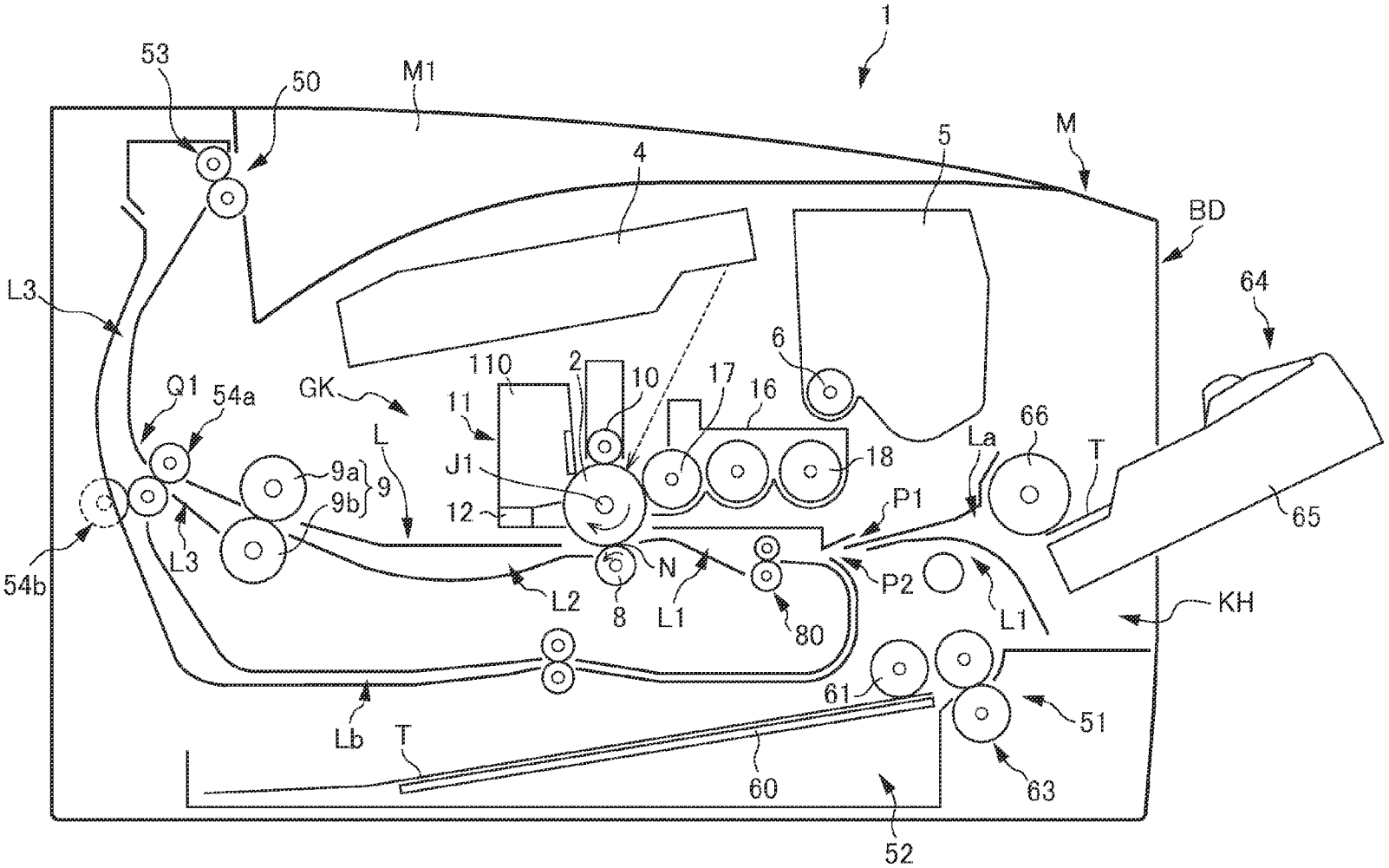
FIG. 1 is a view showing an arrangement of components of a printer 1 of an embodiment of the present disclosure.

As shown in FIG. 1, the printer 1 as the image forming apparatus has an apparatus main unit M, an image forming unit GK, and a paper feeding/discharging portion KH. The image-forming unit GK forms a predetermined toner image on a sheet of paper T as a sheet-like transfer material, based on predetermined image information. The paper feeding/discharging portion KH feeds the sheet of paper T to the image forming unit GK, and discharges the sheet of paper T on which a toner image has been formed. An external shape of the apparatus main unit M is configured with a cabinet BD as its housing.

As shown in FIG. 1, the image-forming unit GK includes a photosensitive drum 2 as an image carrier (photosensitive body), a charging unit 10 that charges the photosensitive drum 2, a laser scanner unit 4 as an exposure unit, a developing unit 16, a toner cartridge 5, a toner supply unit 6, a cleaning device 11, a neutralization device 12, a transfer roller 8 as a transfer unit, and a fixing part 9.

As shown in FIG. 1, the paper feeding/discharging portion KH includes a paper feed cassette 52, a manual paper feed unit 64, a conveyance path L of a sheet of paper T, a pair of resisting rollers 80, and a paper discharging unit 50.

Detailed descriptions are hereinafter provided for configurations of the image-forming unit GK and the paper feeding/discharging portion KH.

First, the image-forming unit GK is described. Charging by the charging unit 10, exposure by the laser scanner unit 4, development by the developing unit 16, transfer by the transfer roller 8, neutralization by the neutralization device 12, and cleaning by the cleaning device 11 are sequentially performed in the order from upstream to downstream along a surface of the photosensitive drum 2 in the image forming unit GK.

The photosensitive drum 2 is composed of, for example, a cylindrical member with an amorphous silicon semiconductor layer formed on its surface, and functions as a photosensitive body or an image carrier. The photosensitive drum 2 is disposed to be rotatable around a first rotation axis J1, which extends in a direction orthogonal to a direction in which a sheet of paper T is conveyed through the conveyance path L, in a direction indicated by an arrow. An electrostatic latent image may be formed on the surface of the photosensitive drum 2.

The charging unit 10 is disposed to face the surface of the photosensitive drum 2. The charging unit 10 includes a charging roller and a charge cleaning brush (not shown). The charging roller provided to the charging unit 10 negatively or positively charges the surface of the photosensitive drum 2 uniformly (with negative or positive polarity). The charge cleaning brush (not shown) provided to the charging unit 10 cleans a surface of the charging roller after the photosensitive drum 2 is charged.

The laser scanner unit 4 functions as an exposure unit, and is disposed to be spaced apart from the surface of the photosensitive drum 2. The laser scanner unit 4 has a laser light source, a polygon mirror, a polygon-mirror-driving motor and the like, none of which are illustrated in the drawings.

The laser scanner unit 4 scans and exposes the surface of the photosensitive drum 2, based on image information that is input from an external device such as a personal computer (PC). The scanning and exposing by the laser scanner unit 4 remove electric charge in an exposed portion on the surface of the photosensitive drum 2. In this way, an electrostatic latent image is formed on the surface of the photosensitive drum 2.

The developing unit 16 is provided correspondingly to the photosensitive drum 2, and is disposed to face the surface of the photosensitive drum 2. The developing unit 16 causes single color toner (black toner, in general) to adhere to an electrostatic latent image formed on the photosensitive drum 2, thereby forming a single color toner image on the surface of the photosensitive drum 2. The developing unit 16 has a developing roller 17 disposed to face the surface of the photosensitive drum 2, an agitation roller 18 for agitating toner, and the like.

The toner cartridge 5 is provided correspondingly to the developing unit 16, and stores toner to be supplied to the developing unit 16.

The toner supply unit 6 is provided correspondingly to the toner cartridge 5 and the developing unit 16, and supplies the toner stored in the toner cartridge 5 to the developing unit 16. The toner supply unit 6 and the developing unit 16 are connected with each other via a toner feed passage (not shown).

The transfer roller 8 transfers a toner image, which has been developed on the surface of the photosensitive drum 2, onto a sheet of paper T. A transfer bias application unit (not shown) applies a transfer bias to the transfer roller 8. The transfer bias is a bias for transferring the toner image formed on the photosensitive drum 2 onto the sheet of paper T.

The transfer roller 8 abuts on, or is separated from, the photosensitive drum 2. More specifically, the transfer roller 8 is configured to be movable between an abutting position to abut on the photosensitive drum 2, and a separated position to be separated from the photosensitive drum 2. In particular, the transfer roller 8 is disposed in the abutting position in a case in which the transfer roller 8 transfers a toner image, which has been developed on the surface of the photosensitive drum 2, onto a sheet of paper T; and the transfer roller 8 is disposed in the separated position in other cases.

The sheet of paper T conveyed through the conveyance path L is interposed between the photosensitive drum 2 and the transfer roller 8. The interposed paper T is pressed against the surface of the photosensitive drum 2. A transfer nip N is formed between the photosensitive drum 2 and the transfer roller 8. In the transfer nip N, the toner image developed on the photosensitive drum 2 is transferred onto the sheet of paper T.

The neutralization device 12 is disposed to face the surface of the photosensitive drum 2. The neutralization device 12 irradiates the surface of the photosensitive drum 2 with neutralization light, thereby discharging electricity (neutralizing electrical charge) on the surface of the photosensitive drum 2, onto which the transfer has been performed.

Detailed descriptions of the neutralization device 12 will be provided later.

The cleaning device 11 is disposed to face the surface of the photosensitive drum 2. The cleaning device 11 removes attached matter such as toner and paper dust remaining on the surface of the photosensitive drum 2, and conveys the attached matter thus removed to a predetermined collecting mechanism for collecting the attached matter.

Figure 2:
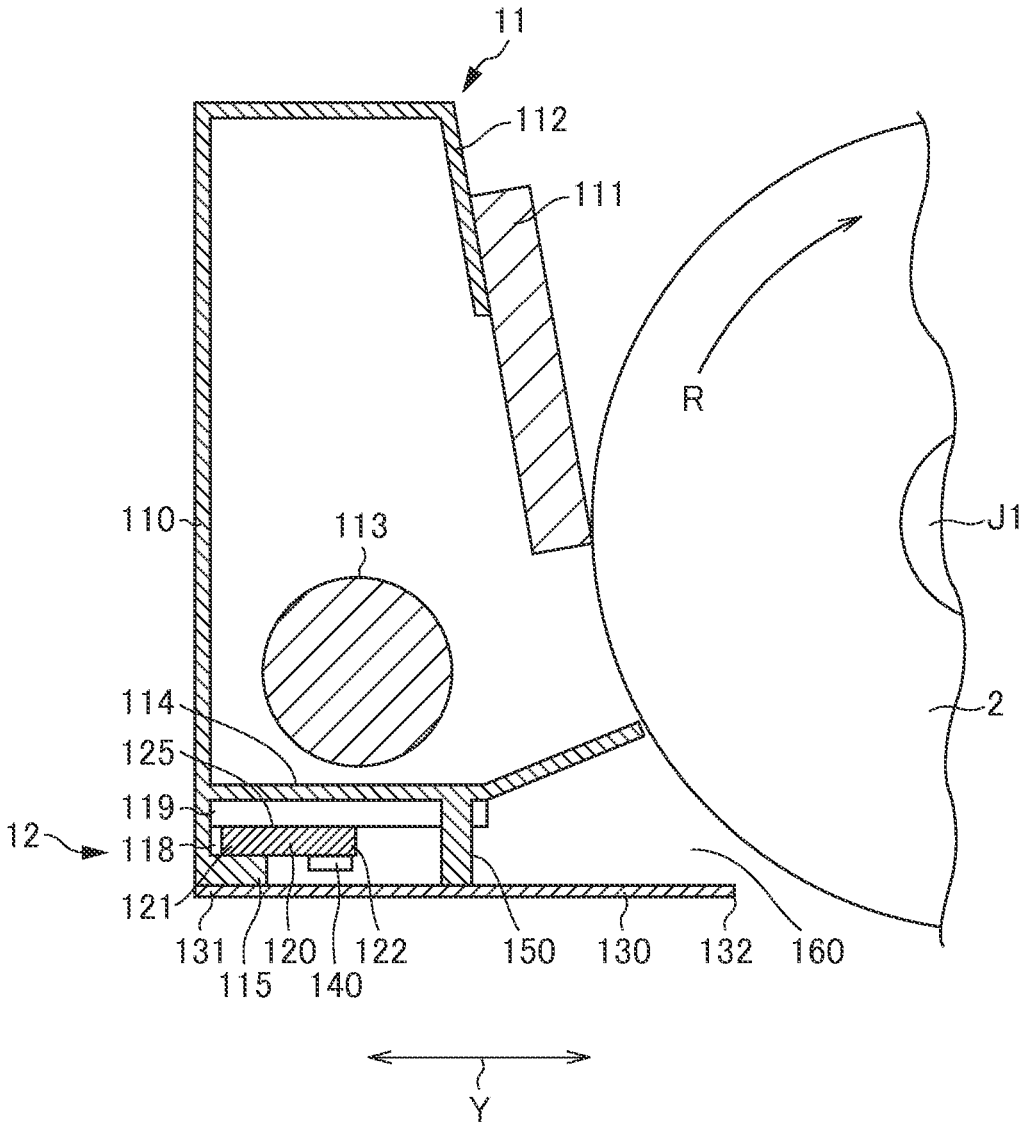
FIG. 2 is a vertical cross sectional view showing a schematic configuration of a neutralization device 12 of the embodiment, which is provided to the printer 1 shown in FIG. 1.

As shown in FIG. 2, the cleaning device 11 includes a housing 110 as a housing, a cleaning blade 111, a blade retaining portion 112, and a collected-toner discharge screw 113.

By melting and pressurizing the toner that forms the toner image transferred onto the sheet of paper T, the fixing part 9 fixes the toner on the sheet of paper T. The fixing part 9 includes a heating rotor 9*a* to be heated by a heater, and a pressing rotor 9*b* to be pressed against the heating rotor 9*a*. The heating rotor 9*a* and the pressing rotor 9*b* interpose, heat, press and convey the sheet of paper T, on which the toner image has been transferred. The sheet of paper T is conveyed while being interposed between the heating rotor 9*a* and the pressing rotor 9*b*. Accordingly, the toner transferred onto the sheet of paper T is melted and pressed, so that the toner is fixed on the sheet of paper T.

Next, the paper feeding/discharging portion KH is described. As shown in FIG. 1, a paper cassette 52 for storing sheets of paper T is disposed in a lower portion of the apparatus main unit M. The paper cassette 52 is configured to be horizontally withdrawable from a right side (right side in FIG. 1) of the apparatus main unit M. A placing board 60 for placing the sheets of paper T is disposed in the paper cassette 52. The paper cassette 52 stores the sheets of paper T stacked on the placing board 60. A sheet of paper T placed on the placing board 60 is fed to the conveyance path L by way of the cassette paper feed unit 51. The cassette paper feed unit 51 is disposed at an end portion on a paper-feeding side in the paper cassette 52 (an end portion on the right in FIG. 1). The cassette paper feed unit 51 includes a double-feed prevention mechanism that is composed of: a forward feed roller 61 for picking up the sheet of paper T from the placing board 60; and a pair of feed rollers 63 for feeding the sheet of paper T to the conveyance path L on a sheet by sheet basis.

A manual paper feed unit 64 is provided on the right side (right side in FIG. 1) in the apparatus main unit M. The manual paper feed unit 64 is provided to the apparatus main unit M mainly for the purpose of supplying other sheets of paper T of sizes or types different from those of the sheets of paper T that are set in the paper cassette 52. The manual paper feed unit 64 includes a manual feed tray 65 and a paper feed roller 66 composing a part of the front face of the apparatus main unit M when the manual feed unit 64 is closed. A bottom edge of the manual feed tray 65 is attached pivotably (openable and closable) to the vicinity of the paper feed roller 66. The sheets of paper T are placed on the manual feed tray 65 when it is open. The paper feed roller 66 feeds the sheet of paper T placed on the manual feed tray 65 when it is open to a manual feed conveyance path La.

A paper discharging unit 50 is provided at an upper portion of the apparatus main unit M. The paper discharging unit 50 discharges the sheet of paper T to outside the apparatus main unit M by a pair of third rollers 53.

The conveyance path L for conveying the sheet of paper T includes: a first conveyance path L1 from the cassette paper feed unit 51 to the transfer nip N; a second conveyance path L2 from the transfer nip N to the fixing part 9; a third conveyance path L3 from the fixing part 9 to the paper discharging unit 50; the manual feed conveyance path La that causes a sheet of paper supplied from the manual paper feed unit 64 to join the first conveyance path L1; and a returning conveyance path Lb. The returning conveyance path Lb is where the paper conveyed from downstream to upstream through the third conveyance path L3 is reversed and then returned to the first conveyance path L1.

Moreover, a first joining portion P1 and a second joining portion P2 are provided somewhere along the first conveyance path L1. A first branching portion Q1 is provided somewhere along the third conveyance path L3. The first joining portion P1 is where the manual feed conveyance path La joins the first conveyance path L1. The second joining portion P2 is where the returning conveyance path Lb joins the first conveyance path L1. The first branching portion Q1 is where the returning conveyance path Lb branches off the third conveyance path L3. In addition, the first branching portion Q1 has a pair of first rollers 54*a* and a pair of second rollers 54*b*. The same roller concurrently serves as one of the pair of first rollers 54*a* and one of the pair of second rollers 54*b*.

A sensor (not shown) for detecting a sheet of paper T and the pair of resisting rollers 80 are disposed somewhere along the first conveyance path L1 (more specifically, between the second joining portion P2 and the transfer roller 8). The pair of resisting rollers 80 is a pair of rollers for correcting skew (diagonal paper feed) of the sheet of paper T, and for adjusting timing of feeding the sheet of paper T with respect to the formation of a toner image in the image forming unit GK. The sensor (not shown) for detecting a sheet of paper T is disposed immediately before the pair of resisting rollers 80 in a direction of conveying the sheet of paper T (upstream in the conveyance direction). The pair of resisting rollers 80 performs the skew correction and timing adjustment based on information related to detection signals sent from the sensor, and conveys the sheet of paper T.

The returning conveyance path Lb is a conveyance path provided for the purpose of causing another surface (unprinted surface) opposite to a surface that has already been printed to face the photosensitive drum 2 when duplex printing is performed on the sheet of paper T.

With the returning conveyance path Lb, it is possible to reverse and return the sheet of paper T, which is conveyed from the first branching portion Q1 to a side closer to the paper discharging unit 50 by the pair of first rollers 54*a*, to the first conveyance path L1 by the second pair of rollers 54*b*. In addition, it is possible to convey the sheet of paper T to upstream from the pair of resisting rollers 80 disposed upstream from the transfer roller 8. In the transfer nip N, a predetermined toner image is transferred onto an unprinted surface of the sheet of paper T that has been reversed through the returning conveyance path Lb.

The paper discharging unit 50 is formed at the end portion of the third conveyance path L3. The paper discharging unit 50 is disposed at the upper portion of the apparatus main unit M. The paper discharging unit 50 is open toward the right side (right side in FIG. 1, and a side closer to the manual paper feed unit 64) of the apparatus main unit M. The paper discharging unit 50 discharges the sheet of paper T conveyed through the third conveyance path L3 to outside the apparatus main unit M by the pair of third rollers 53.

A discharged paper accumulating portion M1 is formed on an opening side of the paper discharging unit 50. The discharged paper accumulating portion M1 is formed on a top face (outer face) of the apparatus main unit M. The discharged paper accumulating portion M1 is where the top face of the apparatus main unit M is formed to be recessed downward. A bottom face of the discharged paper accumulating portion M1 composes a part of the top face of the apparatus main unit M. The sheet of paper T, on which a predetermined toner image has been formed and which has been discharged from the paper discharging unit 50, is stacked and accumulated on the discharged paper accumulating section M1. It should be noted that a sensor for detecting a sheet of paper is disposed in a predetermined position of each conveyance path.

In summary, the printer 1 described above includes: the photosensitive drum 2; the charging unit 10 that is disposed to face and contact the surface of the photosensitive drum 2 to charge the surface of the photosensitive drum 2; the laser scanning unit 4 that forms an electrostatic latent image on the surface of photosensitive drum 2 charged by the charging unit 10; the developing unit 16 that causes toner to adhere to an electrostatic latent image formed by the laser scanning unit 4, and forms a toner image on the surface of the photosensitive drum 2; the transfer roller 8 that directly or indirectly transfers a toner image, which has been formed on the surface of the photosensitive drum 2 by the developing unit 16, onto a sheet of paper T; the neutralization device 12 (to be described later in detail) that irradiates the surface of the photosensitive drum 2 having passed the transfer roller 8 with neutralization light, thereby discharging electricity (neutralizing electrical charge) on the surface of the photosensitive drum 2, onto which the transfer has been performed; and the cleaning device 11 that removes attached matter such as toner remaining on the photosensitive drum 2.

Detailed descriptions are hereinafter provided for the neutralization device 12 of the embodiment with reference to FIGS. 2 to 9B.

As shown in FIG. 2, the neutralization device 12 of the embodiment is disposed upstream from the cleaning device 11 in a rotation direction R of the photosensitive drum 2. As shown in FIG. 2, the neutralization device 12 includes: a housing 110 serving as a housing of the cleaning device 11; a substrate 120 connected to the housing 110; LEDs 140 as light emitting portions for emitting neutralization light; a first end engagement portion 115; a partitioning member 130; and a plurality of restriction protrusions 150.

Figure 3:
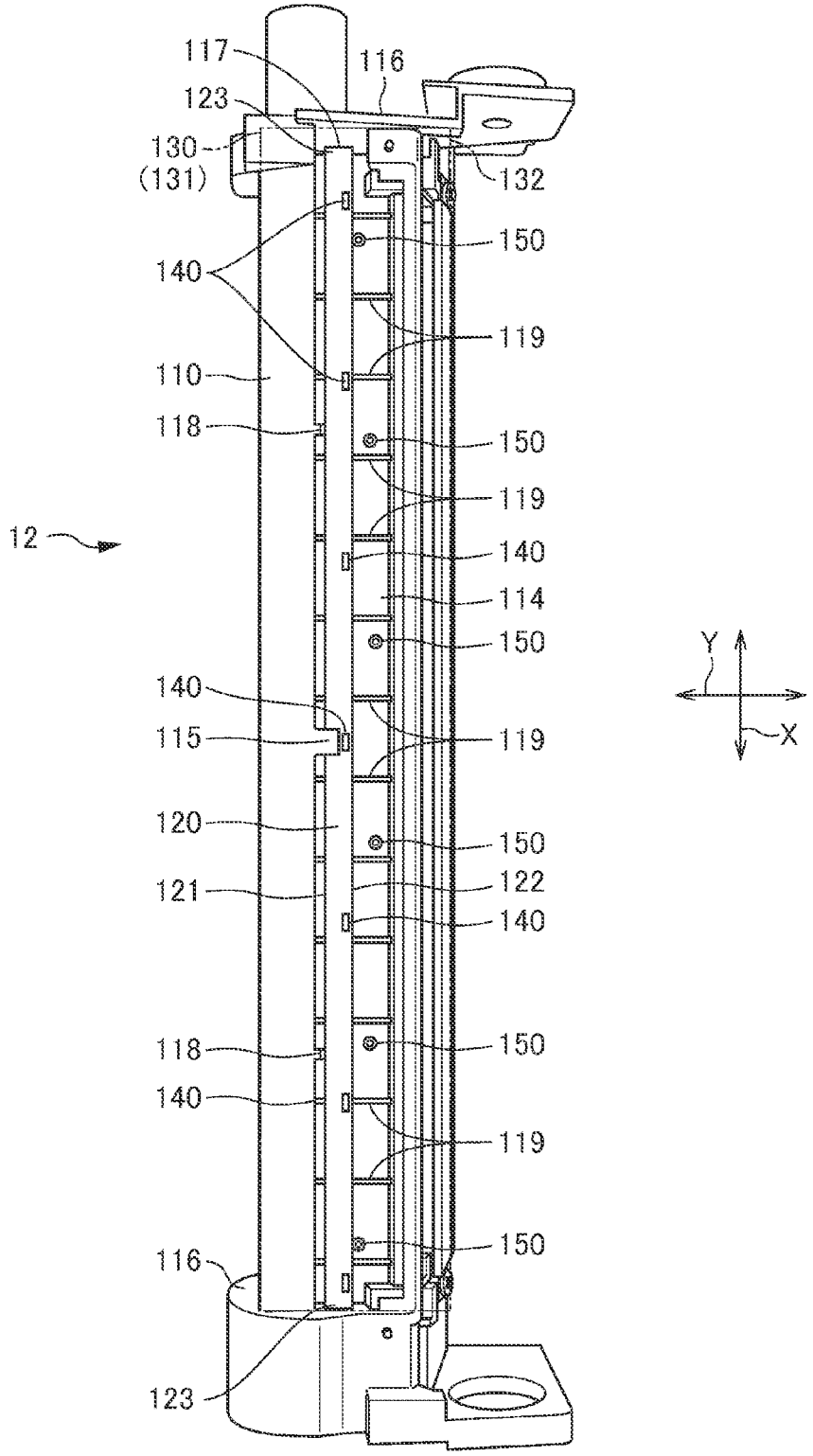
FIG. 3 is a bottom view showing a state where the neutralization device 12 shown in FIG. 2 is viewed from a direction orthogonal to an axial direction of a photosensitive drum 2.
Figure 4:
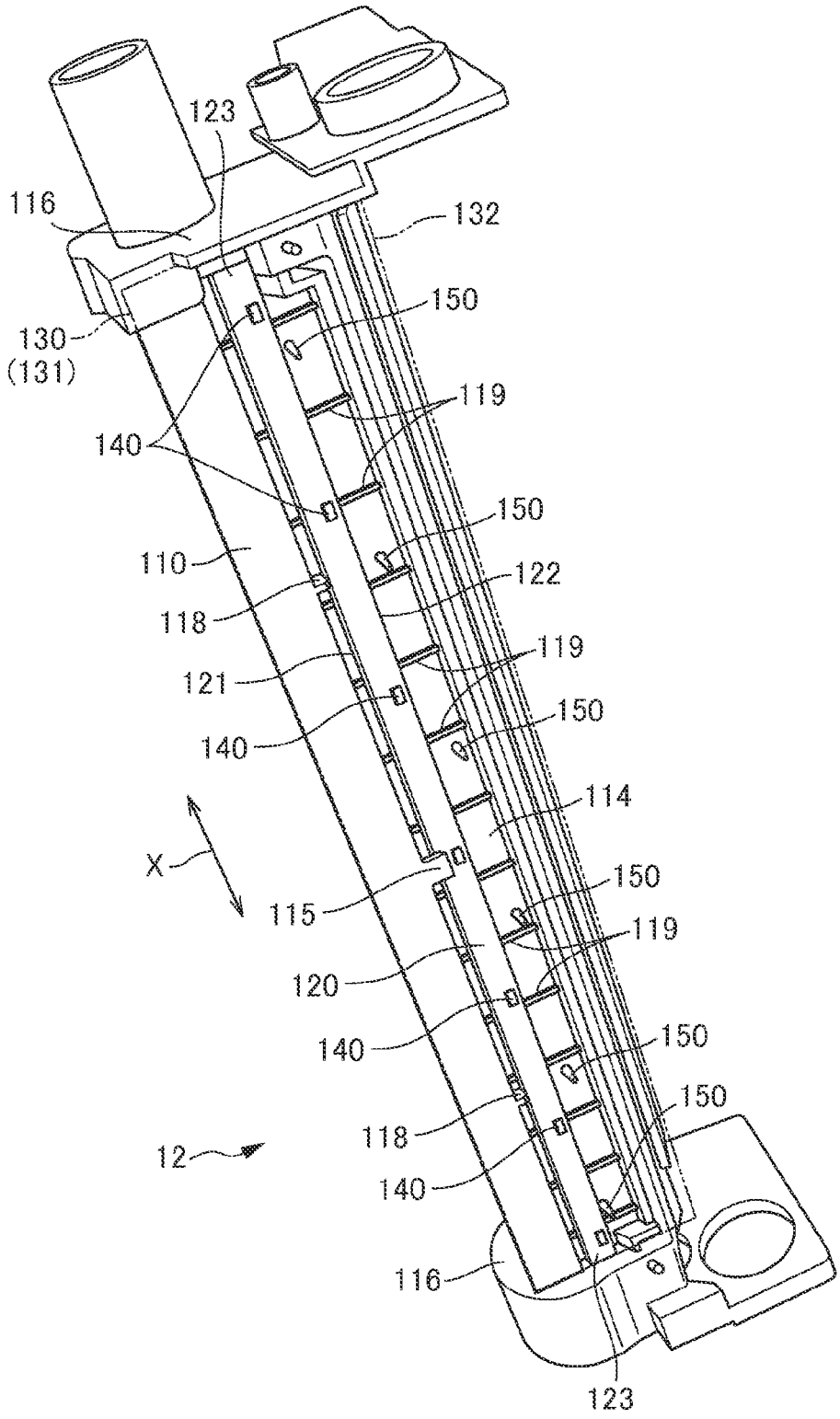
FIG. 4 is a perspective view showing a state where the neutralization device 12 shown in FIG. 3 is viewed from a lower side thereof.
Figure 5:
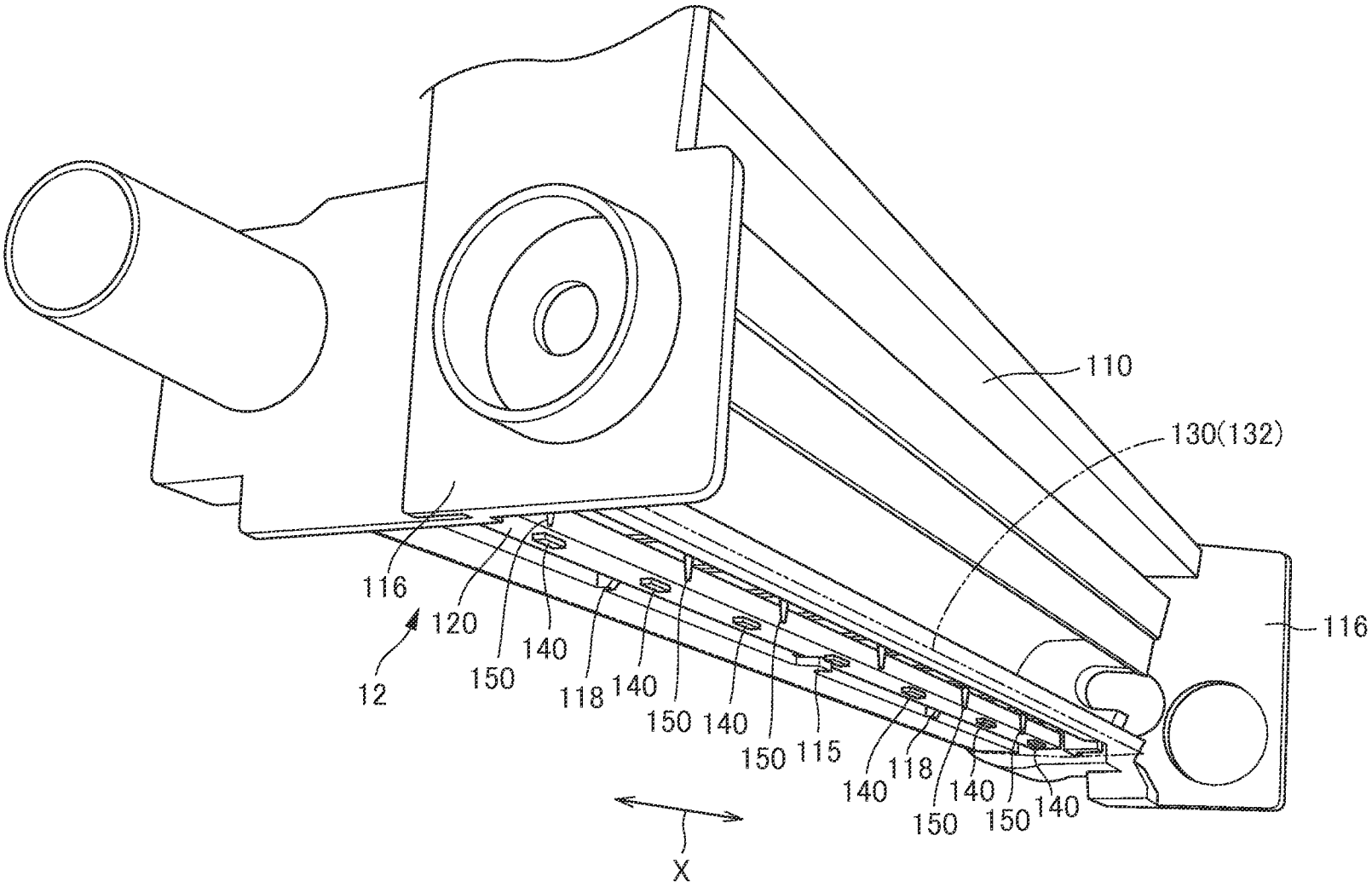
FIG. 5 is a perspective view showing a state where the neutralization device 12 shown in FIG. 3 is viewed from a direction different from that of FIG. 4.

As shown in FIGS. 3 to 5, the substrate 120 has a longitudinal direction X along an axial direction of a first rotation axis J1 of the photosensitive drum 2. The plurality of LEDs 140 are mounted at equal intervals along the longitudinal direction X of the substrate 120, in a state of being arranged on an under surface of the substrate 120. Each of the LEDs 140 is composed of an LED of a side view type. The LEDs 140 emit neutralization light along a direction Y in which the substrate 120 extends (hereinafter also referred to as a "planar direction"), and irradiate the surface of photosensitive drum 2 with the neutralization light thus emitted. Although twenty-one pieces of the LEDs 140 are actually provided as shown in an example illustrated in FIG. 10, only seven pieces thereof are described in the present embodiment for the purpose of simplifying the drawings and descriptions.

As shown in FIGS. 2 to 9B, the first end engagement portion 115 is provided to a lower end portion of the housing 110, and protrudes in a tongue-like manner from a central portion of the substrate 120 in the longitudinal direction X toward the photosensitive drum 2. The first end engagement portion 115 is disposed in a central portion of the plurality of restriction protrusions 150 (to be described below) in an arrangement direction.

The housing 110 includes ribs 119, stop protrusions 118, a lateral plate portion 116, and third end engagement portions 117. The plurality of ribs 119 are formed at intervals in the longitudinal direction X of the substrate 120. The ribs 119 reduce a contact area between a non-mounting face 125, on which the LEDs 140 are not mounted on the substrate 120, and a base plate portion 114 of the housing 110.

The first end engagement portion 115 is engaged with a first end portion 121, which is an end portion of the substrate 120 opposite to the photosensitive drum 2, such that the first end portion 121 is interposed between the first end engagement portion 115 and the ribs 119. The stop protrusions 118 are provided such that the substrate 120, which is engaged between the first end engagement portion 115 and the ribs 119, does not deviate in a direction away from the photosensitive drum 2. The plurality of stop protrusions 118 are formed in the longitudinal direction X of the substrate 120. Although two pieces of the stop protrusions 118 are illustrated in the drawings, there may be three or more pieces thereof.

Figure 6:
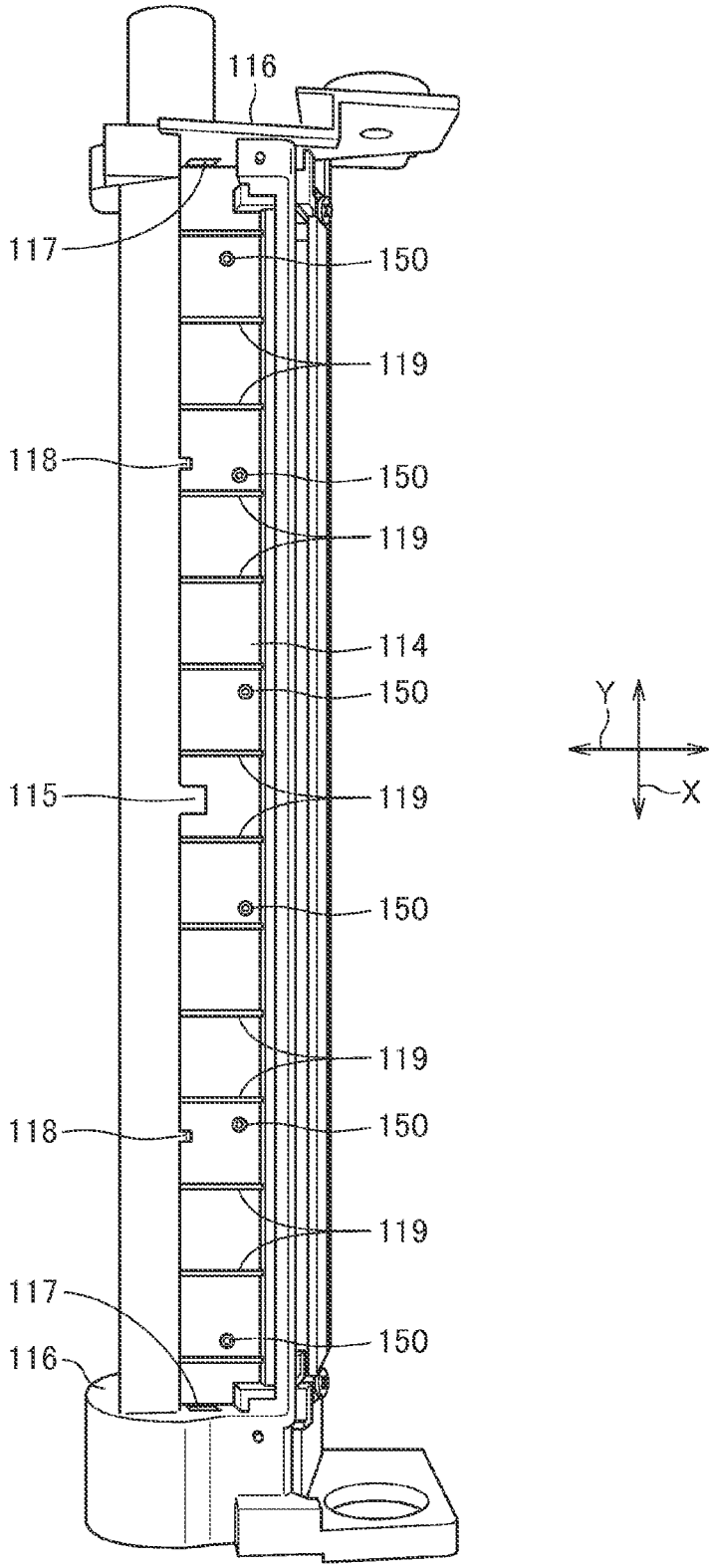
FIG. 6 is a bottom view showing a state where a substrate 120 and a partitioning member 130 are removed from the neutralization device 12 shown in FIG. 3.
Figure 7:
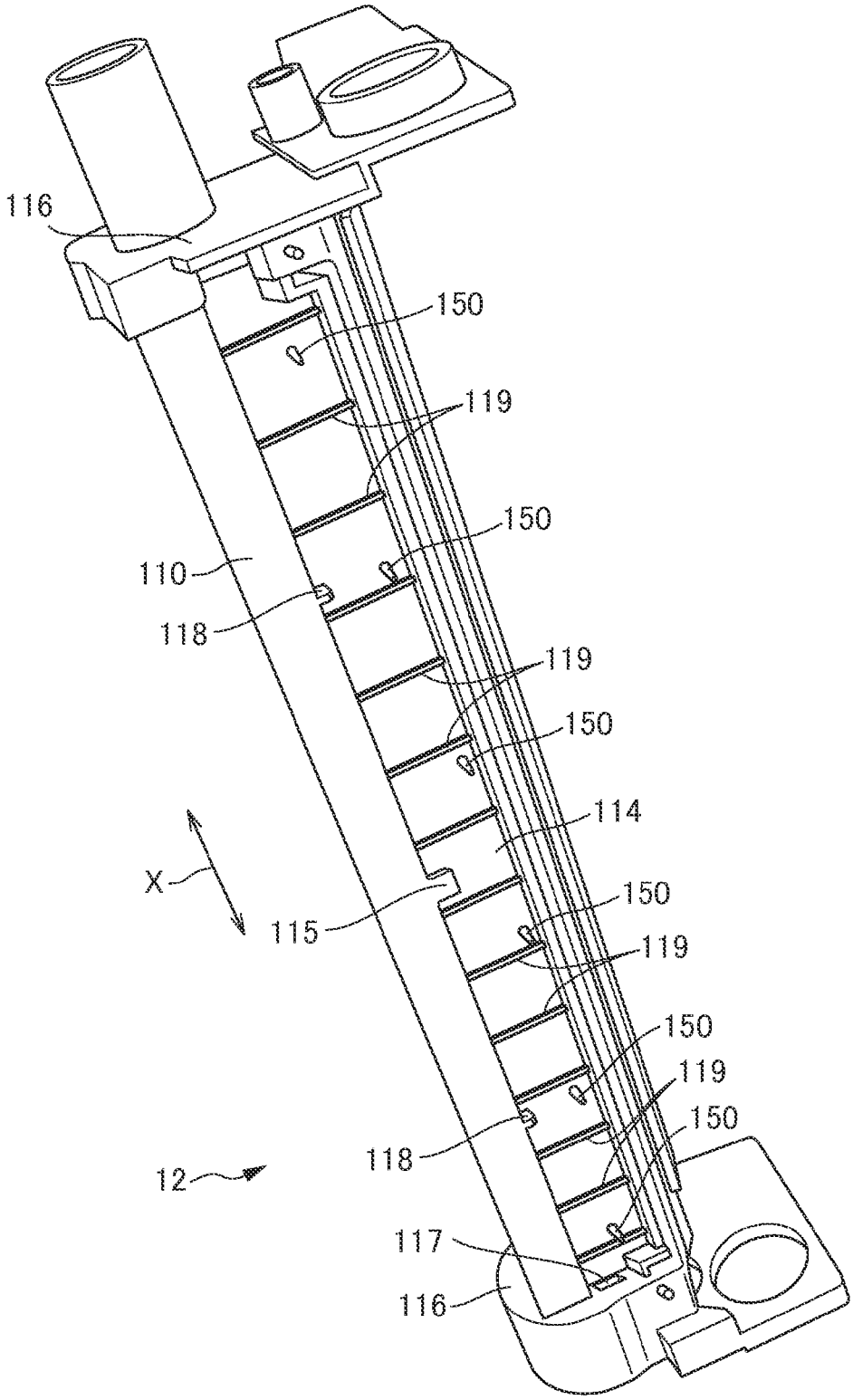
FIG. 7 is a perspective view showing a state where the substrate 120 and the partitioning member 130 are removed from the neutralization device 12 shown in FIG. 4.
Figure 8:
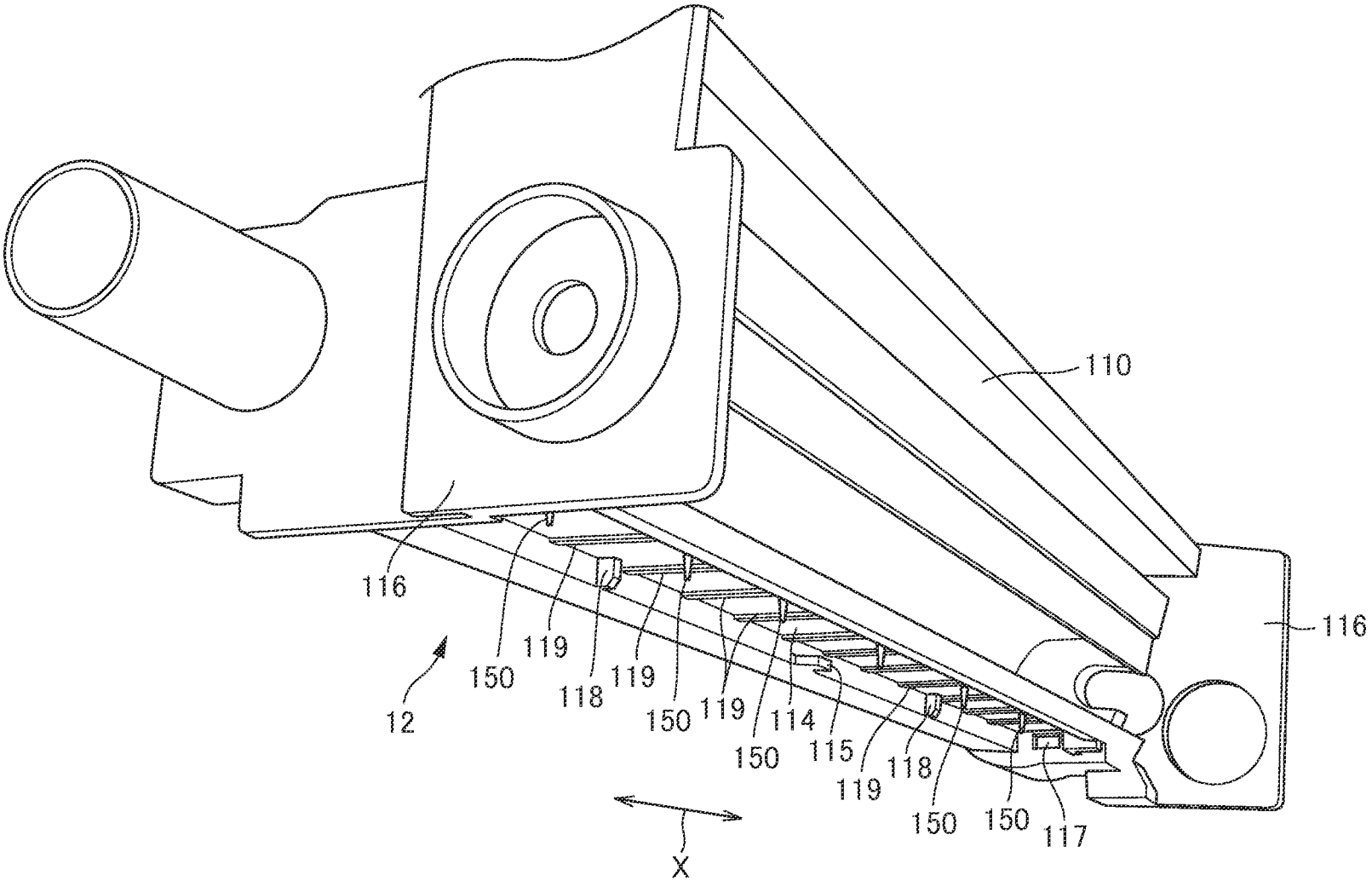
FIG. 8 is a perspective view showing a state where the substrate 120 and the partitioning member 130 are removed from the neutralization device 12 shown in FIG. 5.

As shown in FIG. 6, the pair of lateral plate portions 116 is disposed to face each other at ends of the substrate 120 in the longitudinal direction X. The third end engagement portions 117 are shaped like a long hole, and a pair thereof is provided to the pair of lateral plate portions 116, respectively. A pair of third end portions 123 as end portions of the substrate 120 in the longitudinal direction X is engaged with the pair of third end engagement portions 117, respectively. By engaging the pair of third end portions 123 of the substrate 120 with the pair of third end engagement portions 117 of the housing 110, the substrate 120 is supported to the housing 110 as a both-end-supported beam.

The partitioning member 130 suppresses attachment of toner to the LEDs 140. The partitioning member 130 is formed of resin with low rigidity at low cost, and has a length substantially identical to that of the substrate 120 in the longitudinal direction X of the substrate 120. The partitioning member 130 is disposed so as to interpose the substrate 120 between the partitioning member 130 and the base plate portion 114 of the housing 110. The partitioning member 130 is fixed and connected to the lower end portion of the housing 110 on a base end portion 131 side. The base end portion 131 is an end portion that is located at the furthest position from the photosensitive drum 2 in the direction Y in which the substrate 120 extends. As a result, an opened portion 160 is formed between the partitioning member 130 and the base plate portion 114 of the housing 110. The opened portion 160 is a space for allowing neutralization light to pass therethrough, and is opened so as to face the surface of the photosensitive drum 2.

The plurality of restriction protrusions 150 (six pieces thereof are shown in the embodiment) are provided between the surface of the photosensitive drum 2 and a second end portion 122 that is an end portion opposite to the first end portion 121 of the substrate 120. The plurality of restriction protrusions 150 are arranged in the axial direction of the first rotation axis J1 of the photosensitive drum 2 (i.e. along the longitudinal direction X of the substrate 120). The plurality of restriction protrusions 150 protrude downward integrally from the base plate portion 114 of the housing 110. The plurality of restriction protrusions 150 abut on an intermediate portion of the partitioning member 130 in the planar direction Y of the substrate 120 from above, so as to maintain the opened portion 160 for allowing neutralization light to pass therethrough. As a result, a free end portion 132 of the partitioning member 130 is restricted from approaching the base plate portion 114 of the housing 110.

As shown in FIGS. 3 to 5, the plurality (six pieces) of restriction protrusions 150 and the seven pieces of LEDs 140 are alternately arranged in the longitudinal direction X of the substrate 120. An arrangement direction of the plurality (six pieces) of restriction protrusions 150 curves in a holoscopic view, such that a central portion of the substrate 120 in the longitudinal direction X is closer to the photosensitive drum 2 than ends of the substrate 120 in the longitudinal direction X. Descriptions are hereinafter provided for reasons why the arrangement direction of the restriction protrusions 150 curves as described above.

In the central portion of the substrate 120 in the longitudinal direction X, since adjacent neutralization light beams emitted from the LEDs 140 are likely to overlap, a shading effect due to the presence of the restriction protrusions 150 is small. On the other hand, as the LEDs 140 are closer to the ends of the substrate 120 in the longitudinal direction X, effective quantity of neutralization light emitted by the LEDs 140 decreases; therefore, in the vicinity of the end portions, a shading effect due to the presence of the restriction protrusions 150 is larger, and distribution of quantity of neutralization light is likely to be uneven.

In order to suppress uneven distribution of quantity of neutralization light, it is desirable to dispose the plurality of restriction protrusions 150 as close as possible to the LEDs 140.

Figure 9A:
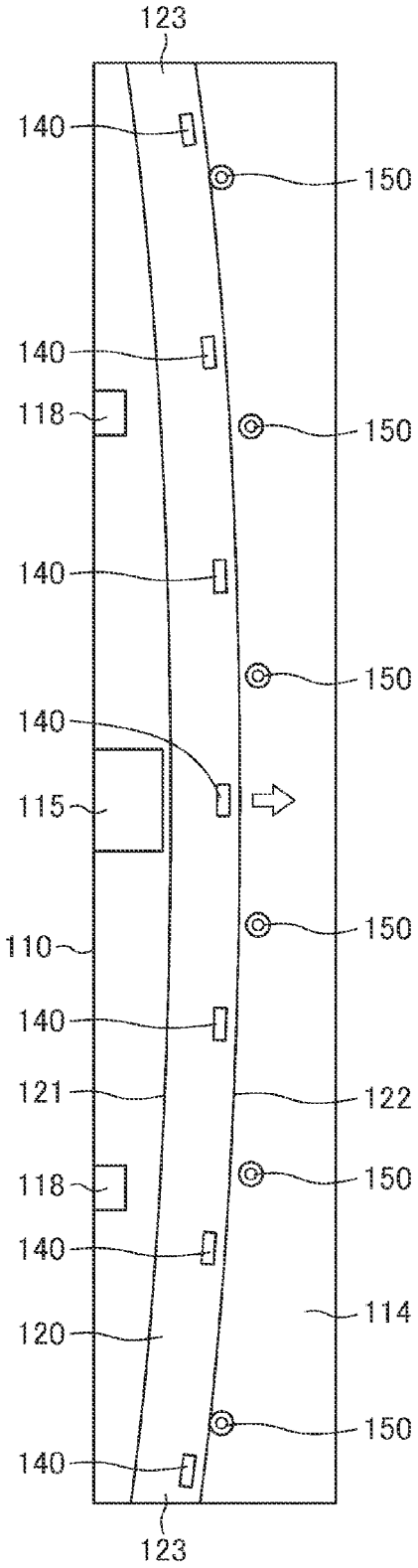
FIG. 9A is a bottom view showing a process of attaching the substrate 120 to a housing 110.

However, as shown in FIG. 9A, when the substrate 120, on which the LEDs 140 are mounted, is attached (assembled) to the housing 110 of the neutralization device 12 having the above configuration, in order to avoid the central portion of the first end portion 121 of the substrate 120 in the longitudinal direction X from interfering with (touching) the first end engagement portion 115 of the housing 110, it is necessary to insert and engage the first end portion 121 of the substrate 120 between the first end engagement portion 115 and the ribs 119, while causing the substrate 120 to curve in an arcuate line as a whole.

Therefore, in a case in which the restriction protrusions 150 are disposed as close as possible to the LEDs 140 in order to reduce the shading effect due to the restriction protrusions 150, the restriction protrusions 150 must be disposed at a distance from the LEDs 140, in consideration of curvature quantity of the substrate 120 when the substrate 120 is attached (assembled) to the housing 110.

Figure 9B:
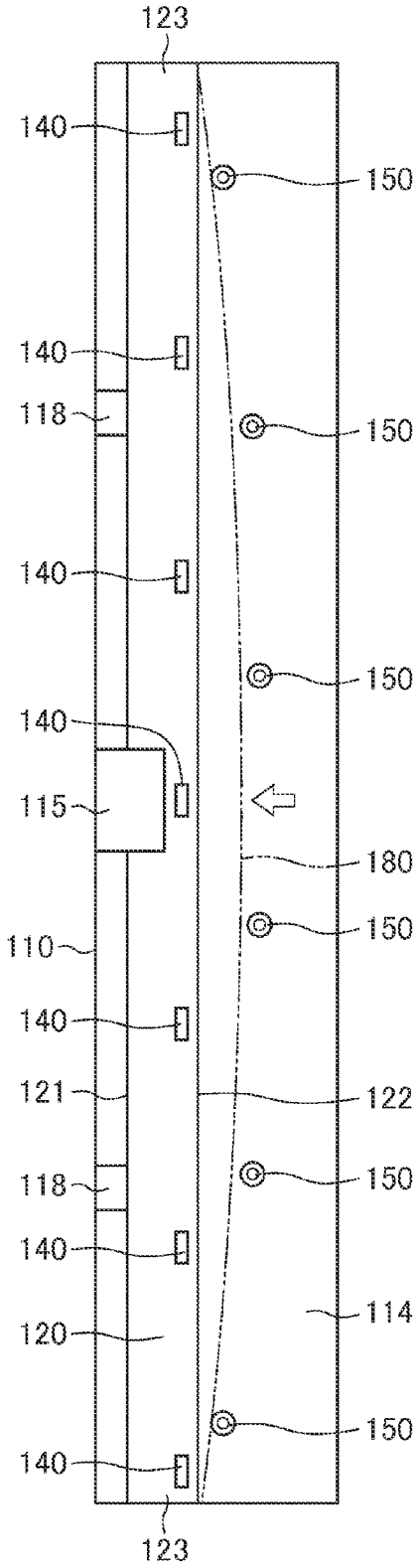
FIG. 9B is a bottom view showing a state where the substrate 120 is attached to the housing 110.

FIG. 9B shows an attached (assembled) state of the substrate 120, in which the substrate 120 curves in an arcuate line, the first end portion 121 of the substrate 120 is inserted and engaged between the first end engagement portion 115 and the ribs 119, and the pair of third end portions 123 at the ends of the substrate 120 in the longitudinal direction X is engaged with the pair of third end engagement portions 117 in the housing 110. The plurality of restriction protrusions 150 are arranged in a curve along an imaginary line 180 showing the second end portion 122 of the substrate 120 that curves when attached to the housing 110, such that the restriction protrusions 150 in the central portion is closer to the photosensitive drum 2 than the restriction protrusions 150 in the end portions.

Furthermore, by arranging the plurality (six pieces) of restriction protrusions 150 according to Equation (1) described below, the restriction protrusions 150 can be disposed as close as possible to the LEDs 140, respectively.

$$\delta_x = \delta_c\left(\frac{3\left(|x| + \frac{L}{2}\right)}{L} - \frac{4\left(|x| + \frac{L}{2}\right)^3}{L^3}\right) \tag{1}$$

Here, when a middle position of the substrate 120 in the longitudinal direction is a home position, x represents an arbitrary position of the substrate 120 in the longitudinal direction X, L represents a distance between supporting positions of the pair of third end portions 123 of the substrate 120, δc represents an amount of flexure in the middle position of the substrate 120, and δx represents an mount of flexure in the arbitrary point x of the substrate 120.

According to the neutralization device 12 of the embodiment described above, for example, the following effects are achieved.

The neutralization device 12 of the present embodiment includes: the substrate 120 connected to the housing 110; the LEDs 140; the first end engagement portion 115; the partitioning member 130; and the restriction protrusions 150. The LEDs 140 are mounted on the substrate 120, and emit neutralization light. The first end engagement portion 115 is engaged with the first end portion 121 that is the end portion of the substrate 120 opposite to the photosensitive drum 2. The partitioning member 130 is disposed to interpose the substrate 120 between the partitioning member 130 and the housing 110, and suppresses attachment of toner to the LEDs 140. The partitioning member 130 is connected to the housing 110 on the base end portion 131 side of the partitioning member 130, so as to form the opened portion 160, which is opened to face the surface of the photosensitive drum 2, between the housing 110 and the partitioning member 130. The plurality of restriction protrusions 150 are arranged along the axial direction of the photosensitive drum 2, between the surface of the photosensitive drum 2 and the second end portion 122 that is the end portion opposite to the first end portion 121 of the substrate 120. The restriction protrusions 150 restrict the free end portion 132 side of the partitioning member 130 from approaching the housing 110, such that the opened portion 160 is maintained. The first end engagement portion 115 is disposed in the central portion of the plurality of restriction protrusions 150 in the arrangement direction. The arrangement direction of the plurality of restriction protrusions 150 curves in a holoscopic view, such that the central portion of the restriction protrusions 150 in the axial direction of the photosensitive drum 2 is closer to the photosensitive drum 2 than the end portions of the restriction protrusions 150 in the axial direction.

As a result, even in a case in which the neutralization device 12 is disposed in a position, which is upstream from the cleaning device 11 in the rotation direction R of the photosensitive drum 2, and which is near downstream from the transfer unit, the presence of the partitioning member 130 makes it possible to suppress attachment of toner before transfer and toner scattered after transfer to a sheet of paper or the like to the LEDs 140 of the neutralization device 12, and to protect the neutralization device 12 from the scattered toner.

The plurality of restriction protrusions 150 restrict the free end portion 132 side (in particular, the central portion) of the partitioning member 130 from approaching the housing 110, thereby making it possible to maintain the opened portion 160 that is formed between the housing 110 and the partitioning member 130. As a result, it is possible to suppress reduction of quantity of neutralization light that is emitted from the LEDs 140 to irradiate the photosensitive drum 2.

In addition, the plurality of restriction protrusions 150 are arranged in a curve line, such that the central portion of the restriction protrusions 150 in the axial direction of the photosensitive drum 2 is closer to the photosensitive drum 2 than the end portions of the restriction protrusions 150 in the axial direction; therefore, it is possible to suppress further reduction of effective light quantity by the shading due to the restriction protrusions 150, in which neutralization light beams emitted from the LEDs 140 in the end portions to irradiate the photosensitive drum 2 are unlikely to overlap. Therefore, it is possible to reduce the shading effect of neutralization light due to the restriction protrusions 150, and to distribute the quantity of neutralization light on the surface of the photosensitive drum 2 uniformly in the axial direction of the photosensitive drum 2.

In the neutralization device 12 of the embodiment, the plurality of restriction protrusions 150 are arranged according to Equation (1) described above. Therefore, the restriction protrusions 150 can be disposed as close as possible to the LEDs 140, within a range that does not affect the curving of the substrate 120 when the substrate 120 is attached to the housing 110. As a result, it is possible to minimize the shading effect of neutralization light due to the presence of the restriction protrusions 150, and to further improve the uniformity of distribution of neutralization light.

In the neutralization device 12 of the embodiment, the housing 110 includes the pair of third end engagement portions 117 that is engaged with the pair of third end portions 123, respectively, as the end portions of the substrate 120 in the longitudinal direction X. As a result, by engaging the pair of third end portions 123 of the substrate 120 with the pair of third end engagement portions 117 of the housing 110, the substrate 120 can be supported to the housing 110 as a both-end-supported beam. Therefore, it is easily possible to cause the substrate 120 to curve when the substrate 120 is attached to the housing 110, and the substrate 120 can be securely attached to the housing 110.

In the neutralization device 12 of the embodiment, the ribs 119 are provided between the non-mounting face 125 of the substrate 120 and the base plate portion 114 of the housing 110, for the purpose of reducing the contact area therebetween. Therefore, the heat involved with the light emitted by the LEDs 140 is transferred to the housing 110 side, and it is possible to suppress increase of temperature of toner collected into the housing 110.

EXAMPLE

An example of the present disclosure is hereinafter described with reference to FIGS. 10 and 11.

Figure 10:
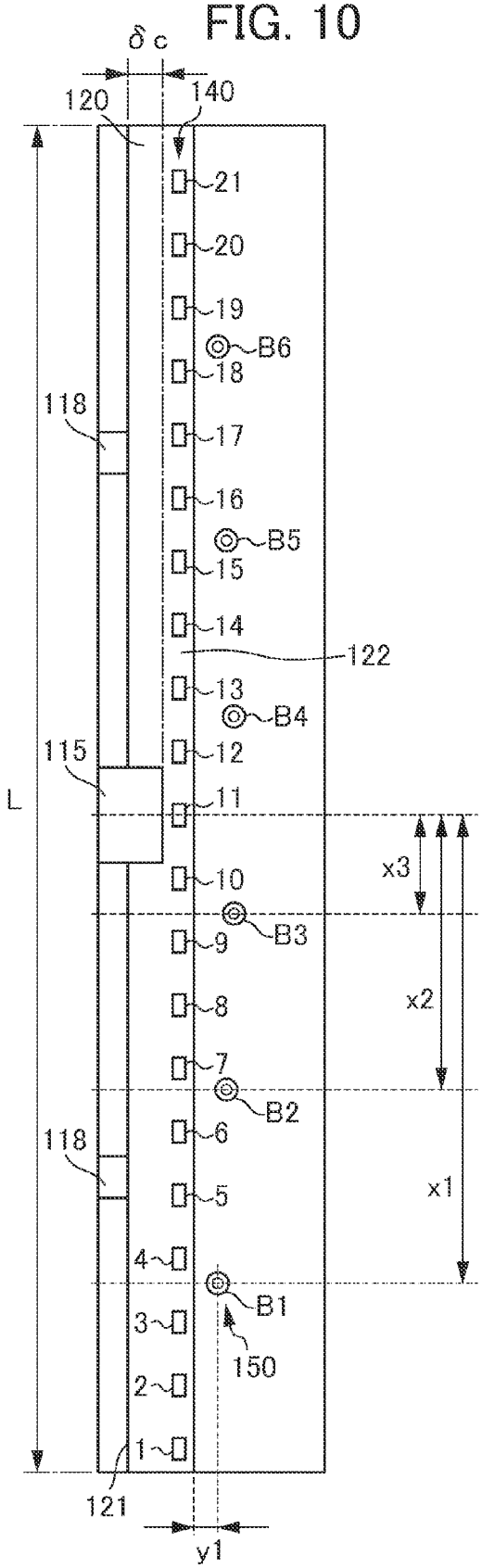
FIG. 10 is a bottom view of essential parts of the neutralization device 12 in an example.

As shown in FIG. 10, in the neutralization device 12 of the example, there are twenty-one LEDs 140 as denoted by sub reference numerals 1 to 21. An LED 140 (11) located in the center of the twenty-one LEDs 140 is located in the central portion of the substrate 120 in the longitudinal direction X (i.e. a position corresponding to the first end engagement portion 115). Table 1 below shows positions of the twenty-one LEDs 140 (1) to (21) along the longitudinal direction X of the substrate 120.

TABLE 1

| LED NUMBER | POSITION IN DIRECTION x (mm) |
|---|---|
| 1 | −110 |
| 2 | −101 |
| 3 | −89 |
| 4 | −78 |
| 5 | −67 |
| 6 | −56 |
| 7 | −44 |
| 8 | −33 |
| 9 | −22 |
| 10 | −11 |
| 11 | 0 |
| 12 | 11 |
| 13 | 22 |
| 14 | 33 |
| 15 | 44 |
| 16 | 56 |
| 17 | 67 |
| 18 | 78 |
| 19 | 89 |
| 20 | 101 |
| 21 | 110 |

There are six restriction protrusions 150 as denoted by sub reference numerals B1 to B6. The restriction protrusions 150 have a cylindrical shape with a diameter of 1 mm. Distances from the middle position of the substrate 120 in the longitudinal direction X to the centers of the individual restriction protrusions 150 (B1) to 150 (B6) are denoted as x1 to x6, respectively. Distances from the second end portion 122 of the substrate 120 to the centers of the restriction protrusions 150 (B1) to 150 (B6) are denoted as y1 to y6, respectively. In FIG. 10, illustrations of the reference numerals x4 to x6 and y2 to y6 are omitted. Table 2 below shows the distances x1 to x6 and y1 to y6 regarding the restriction protrusions 150 (B1) to (B6).

TABLE 2

| RESTRICTION PROTRUSION NUMBER | xn | DISTANCE x FROM HOME POSITION 0 (mm) | yn | POSITION IN DIRECTION y |
|---|---|---|---|---|
| B1 | x1 | −83.5 | y1 | 1.942 |
| B2 | x2 | −50.0 | y2 | 2.276 |
| B3 | x3 | −16.5 | y3 | 2.473 |
| B4 | x4 | 16.5 | y4 | 2.473 |
| B5 | x5 | 50.0 | y5 | 2.276 |
| B6 | x6 | 83.5 | y6 | 1.942 |

Figure 11:
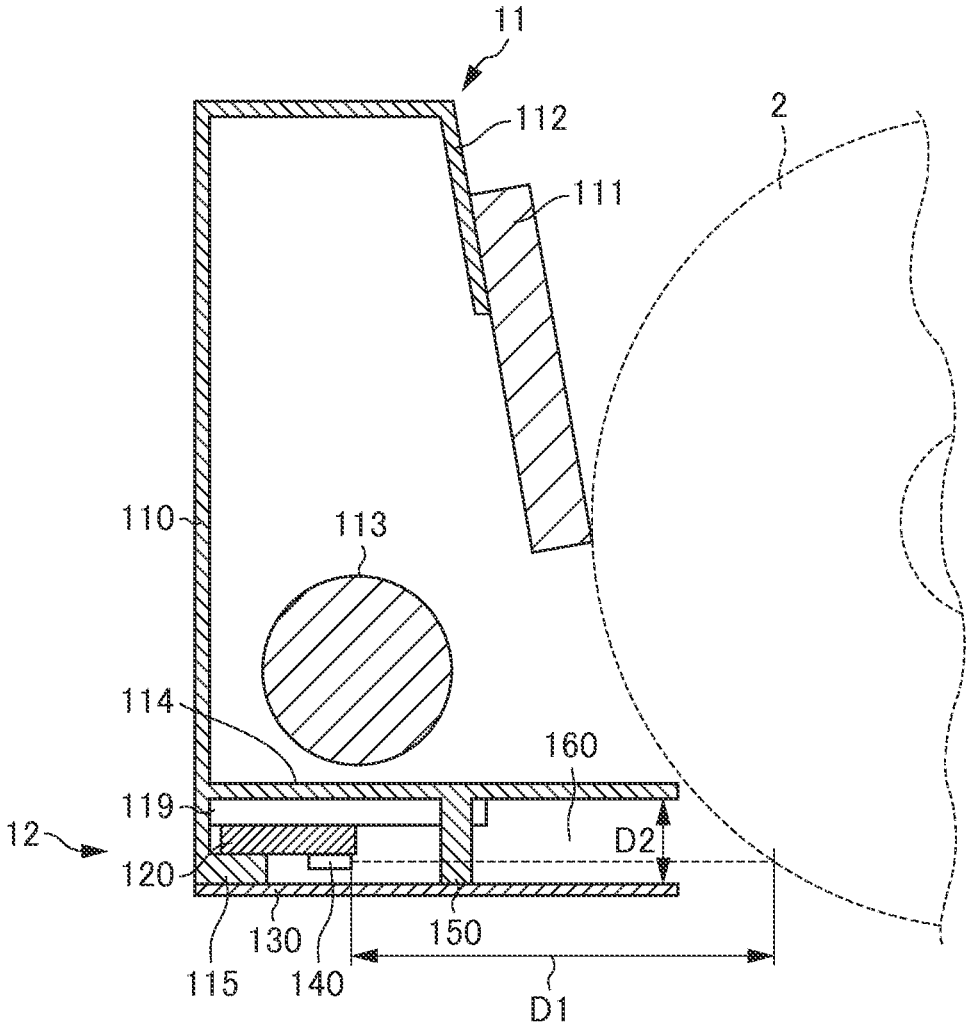
FIG. 11 is a longitudinal sectional view of the essential parts of the neutralization device 12 in the example.

As shown in FIGS. 10 and 11, a distance L between the positions of supporting the pair of third end portions 123 of the substrate 120 is 240 mm. A distance D1 from the LED 140 to the surface of the photosensitive drum 2 is 18.6 mm. A width D2 of the opened portion 160 in a vertical direction (a thickness direction of the partitioning member 130) is 2.5 mm. LEDs with a half-intensity full angle (a beam divergence angle) of 120 degrees were used as the LEDs 140.

In the neutralization device 12 having the specification as described above, the positions of the LEDs 140 (1) to (21) and the coordinates of the restriction protrusions 150 (B1) to (B6) were calculated by using Equation (1) described above to obtain results shown in Tables 1 and 2.

The positions of the restriction protrusions 150 (B1) to (B6) are values that are obtained by adding: an amount of curvature (an amount of flexure) δc (=1 mm) from the first end portion 121 of the substrate 120 to the substrate 120; a radius (=1 mm) of the restriction protrusions 150 (B1) to (B6); and a clearance (=0.5 mm).

By arranging the restriction protrusions B1 to B6, based on the positions and coordinates obtained as described above, the restriction protrusions B1 to B6 can be disposed in positions as close as possible to the LED chips 1 to 21. Therefore, the shading effect of neutralization light due to the restriction protrusions B1 to B6 can be minimized, and the distribution of neutralization light in the axial direction of the photosensitive drum 2 can be equalized.

Although the preferred embodiment has been described above, the present disclosure is not limited to the aforementioned embodiment, and can be carried out in various modes.

For example, the embodiment has been described above for a case in which the restriction protrusions 150 with the cylindrical shape were used, but the shape thereof is not limited thereto, and restriction protrusions 150 with a rectangular column shape or a tabular shape may be used.

The embodiment has been described above for the image forming apparatus as the printer 1 that forms a monochrome toner image, but the image forming apparatus is not limited thereto. A type of the image forming apparatus of the present disclosure is not limited in particular, and may be a copying machine, a printer, a facsimile, a multi-function device thereof, or the like. The transfer material is not limited to a sheet of paper, and may be, for example, a film sheet.

The invention claimed is:

1. A neutralization device configured to irradiate a surface of an electrically charged image carrier with neutralization light to discharge electricity of the image carrier, the neutralization device comprising:

a housing;

a substrate connected to the housing, said substrate being a structurally separate element with respect to the housing;

a plurality of light emitting portions mounted on the substrate and configured to emit neutralization light;

a first end engagement portion engaged with a first end portion, which is an end portion of the substrate opposite to the image carrier;

a partitioning member disposed to interpose the substrate between the partitioning member and the housing, said partitioning member connected to the housing on an end side of the partitioning member so as to form an opened portion that is opened to face the surface of the image carrier; and a plurality of restriction protrusions arranged at a base plate portion of the housing along an axial direction of the image carrier, said restriction protrusions being configured to be spaced away from a second end portion opposite to the first end portion of the substrate towards the image carrier and to project from the base plate portion downwardly to the partitioning member, wherein the first end engagement portion is disposed in a central portion of an arrangement of the plurality of restriction protrusions, wherein the arrangement of the plurality of restriction protrusions curves in an overall view along an imaginary line showing the second end portion of the substrate that curves when attached to the housing, such that a restriction protrusion at the central portion of the arrangement in the axial direction is closer to the image carrier than restriction protrusions at both end portions of the arrangement in the axial direction, wherein the plurality of light emitting portions are arranged along the axial direction of the image carrier, and wherein the plurality of restriction protrusions and the plurality of light emitting portions are alternately arranged in the axial direction of the image carrier.

2. The neutralization device according to claim 1, wherein the substrate has a longitudinal direction along the axial direction of the image carrier, and is supported to the housing as a both-end-supported beam on a pair of third end portions that are end portions thereof in the longitudinal direction, and wherein an amount of flexure δx at an arbitrary point x of the substrate is expressed by Equation 1 below:

$$\delta_x = \delta_c\left(\frac{3\left(|x| + \frac{L}{2}\right)}{L} - \frac{4\left(|x| + \frac{L}{2}\right)^3}{L^3}\right) \quad (1)$$

where a middle position of the substrate in the longitudinal direction is an origin, x represents an arbitrary position of the substrate in the longitudinal direction, L represents a distance between positions of supporting the pair of third end portions of the substrate, and δc represents an amount of flexure in the middle position of the substrate.

3. The neutralization device according to claim 2, wherein the housing includes third end engagement portions that are engaged with the pair of third end portions of the substrate, respectively.

4. The neutralization device according to claim 1, wherein the restriction protrusions project downward, and wherein the first end engagement portion is engaged with the first end portion of the substrate from below.

5. The neutralization device according to claim 2, wherein the restriction protrusions project downward, and wherein the first end engagement portion is engaged with the first end portion of the substrate from below.

6. The neutralization device according to claim 3, wherein the restriction protrusions project downward, and wherein the first end engagement portion is engaged with the first end portion of the substrate from below.

7. The neutralization device according to claim 1, wherein the light emitting portions emit neutralization light along a direction in which the substrate extends.

8. The neutralization device according to claim 2, wherein the light emitting portions emit neutralization light along a direction in which the substrate extends.

9. The neutralization device according to claim 3, wherein the light emitting portions emit neutralization light along a direction in which the substrate extends.

10. The neutralization device according to claim 4, wherein the light emitting portions emit neutralization light along a direction in which the substrate extends.

11. The neutralization device according to claim 1, wherein the housing includes ribs that reduce a contact area between the housing and a non-mounting face of the substrate, on which the light emitting portions are not mounted.

12. An image forming apparatus, comprising:

an image carrier;

a charging unit that charges the image carrier;

an exposure unit that forms an electrostatic latent image on a surface of the image carrier;

a developing unit that forms a toner image by developing the electrostatic latent image, which is formed by the exposure unit, with toner; and the neutralization device according to claim 1, which irradiates the surface of the image carrier with neutralization light to discharge electricity of the image carrier.

13. A neutralization device configured to irradiate a surface of an electrically charged image carrier with neutralization light to discharge electricity of the image carrier, the neutralization device comprising:

a housing;

a substrate connected to the housing;

a plurality of light emitting portions mounted on the substrate and configured to emit neutralization light;

a first end engagement portion engaged with a first end portion that is an end portion of the substrate opposite to the image carrier;

a partitioning member disposed to interpose the substrate between the partitioning member and the housing, said partitioning member connected to the housing on an end side of the partitioning member so as to form an opened portion that is opened to face the surface of the image carrier; and a plurality of restriction protrusions arranged along an axial direction of the image carrier between the surface of the image carrier and a second end portion opposite to the first end portion of the substrate, wherein the first end engagement portion is disposed in a central portion of an arrangement of the plurality of restriction protrusions, wherein the arrangement of the plurality of restriction protrusions curves in an overall view along an imaginary line showing the second end portion of the substrate that curves when attached to the housing, such that a restriction protrusion at the central portion of the arrangement in the axial direction is closer to the image carrier than restriction protrusions at both end portions of the arrangement in the axial direction, wherein the plurality of light emitting portions are arranged along the axial direction of the image carrier, and wherein the plurality of restriction protrusions and the plurality of light emitting portions are alternately arranged in the axial direction of the image carrier wherein the substrate has a pair of third end portions arranged in a longitudinal direction along the axial direction of the image carrier, the pair of third end portions being engaged with third end engagement portions of the housing such that the substrate is supported to the housing as a both-end-supported beam, and wherein an amount of flexure δx at an arbitrary point x of the substrate is expressed by Equation 1 below:

$$\delta_x = \delta_c\left(\frac{3\left(|x| + \frac{L}{2}\right)}{L} - \frac{4\left(|x| + \frac{L}{2}\right)^3}{L^3}\right) \quad (1)$$

wherein a middle position of the substrate in the longitudinal direction is an origin, x represents an arbitrary position of the substrate in the longitudinal direction, L represents a distance between positions of supporting the pair of third end portions of the substrate, and δc represents an amount of flexure in the middle position of the substrate.

* * * * *